United States Patent [19]

Pell

[11] 4,362,303

[45] Dec. 7, 1982

[54] TABLE GAME EMPLOYING TWO SETS OF CARDS

[76] Inventor: Philip T. Pell, P.O. Box 125, Pilot Mountain, N.C. 27041

[21] Appl. No.: 187,571

[22] Filed: Sep. 15, 1980

[51] Int. Cl.[3] ..... A63F 3/00

[52] U.S. Cl. ..... 273/274

[58] Field of Search ..... 273/274

[56] References Cited

U.S. PATENT DOCUMENTS

| | | | |
|---|---|---|---|
| 3,663,021 | 5/1972 | Whippo | 273/274 X |
| 3,667,757 | 6/1972 | Holmberg | 273/274 |
| 3,998,462 | 12/1976 | Goott | 273/274 X |
| 4,222,572 | 9/1980 | Baker | 273/274 X |
| 4,312,508 | 1/1982 | Wood | 273/274 |

FOREIGN PATENT DOCUMENTS

| | | | |
|---|---|---|---|
| 957290 | 8/1949 | France | 273/274 |
| 949733 | 2/1964 | United Kingdom | 273/274 |
| 1051062 | 12/1966 | United Kingdom | 273/274 |

OTHER PUBLICATIONS

Scarne's Encyclopedia of Games, by John Scarne, publ. by Harper & Row, New York, copyrighted 1973, p. 323.

*Primary Examiner*—Anton O. Oechsle

[57] ABSTRACT

A novel, fast-moving, interesting, and easy-to-learn game based upon the probability of the occurrance of selected relationships between events randomly generated from sets of possible events. One embodiment is a card game utilizing a table surface having on it a plurality of defined player areas. A dealer using two or more decks of conventional playing cards, deals cards two at a time for each play. Each player attempts to predict the relationship which the two dealt cards will have. The dealer wins the play in the event the two dealt cards are identical, regardless of the accuracy of any player's prediction, otherwise the dealer determines which of the players have predicted accurately and then awards chips to each player who has made an accurate prediction and collects chips from players whose predictions were wrong.

4 Claims, 2 Drawing Figures

TABLE GAME EMPLOYING TWO SETS OF CARDS

BACKGROUND OF THE INVENTION

The invention pertains generally to the field of games normally played indoors. More specifically, the invention relates to games of chance run by an operator for simultaneous participation by a number of players, usually up to about ten. Existing games of this general type, such as bridge, canasta, poker, black-jack, roulette, craps, bingo, rook, etc. are old games which are still popular, but some of these games are difficult to learn and to play, some require extended periods of time to play, and others require highly developed skills of concentration and memory.

SUMMARY OF THE INVENTION

It is accordingly an object of the invention to provide a new game which is fast-moving, interesting and easy to learn.

It is a further object of the invention to provide a game which can be adapted to be played in many different forms.

It is another object of the invention to provide a game which is relaxing and does not require special skills or concentration to play.

These and other objects are accomplished in accordance with the present invention by providing a new, fast-moving, interesting and easy-to-learn game based on the probability of the occurrance of selected relationships between events randomly generated from sets of known possible events.

According to one embodiment of the invention there is provided a card game which utilizes a table surface having on it a plurality of defined player areas. A player area may be of any shape, however a triangular shaped area as shown in the drawings is the preferred shape. Within each player area there are prediction spaces where one or more chips or other prediction-indicating pieces may be placed to indicate a prediction. There are indicia within each prediction space showing the relationship which is predicted if that space is used. Also within each prediction space the probability that the predicted relationship shown in that space will occur is indicated alphanumerically. The probability can be stated in different ways, however it is preferred to state it in terms of reward ratio such as 16 for 1 instead of 1 in 16, for example.

The operator of the game is a dealer who uses two or more decks of conventional playing cards and deals cards two at a time for each play. Each player attempts to predict the relationship which the two dealt cards will have. He does this by placing chips in one or more defined areas on the playing surface to indicate his prediction that the two cards to be dealt with have a particular relationship, such as both red or both black, both of the same suit, both of a specified suit, any pair, et cetera. The dealer wins the play if the two dealt cards are identical, regardless of the accuracy of any player's prediction, and collects all chips from the playing surface. Otherwise the dealer determines which of the players has predicted accurately, awards chips to each player who has made an accurate prediction, and collects chips from those players whose predictions were wrong. Each player who wins is rewarded with a number of chips proportional to the probability of his prediction occurring. For example, if a player predicted that the two dealt cards would both be hearts and placed two chips on the playing surface at a location indicating such as his prediction, then if the two dealt cards are both hearts he is awarded 30 chips plus the 2 he had put on the table for a total of 32, the pay-off for this prediction being 16 for 1, since the probability of two hearts being dealt is 1 in 16 or odds of 15 to 1 against.

In accordance with another embodiment of the invention, the operator is an electronic computer programmed to generate and display a random event from each of two or more sets of possible events. The sets of possible events from which the random events are generated by the computer are chosen to provide interest and challenge to players of the game. It is also essential that there be at least one possible event common to all sets. For persons who like card games the sets of possible events may correspond to the 52 cards in a conventional deck of playing cards. To play the game a player indicates on the computer keyboard his prediction of the relationship which will exist between the random events to be generated. He then presses the GO button on the keyboard and the computer indicates a randomly-selected event from each of sets of possible events. If the player's prediction was correct, the computer adds to the player's score a number of points proportional to the probability of the predicted events occurring. If the player's prediction was wrong, a point is subtracted from the player's score by the computer. The computer also subtracts a point from the player's score if the generated events are identical. Thus, for example, if the player predicts that the two generated events will be of the same suit (any suit), and that turns out to be the case, the computer awards the player 4 points, because the probability of that happening is one in four. To add interest to the game, the computer can be constructed to play the game with a number of players at the same time, keeping score for each. A preferred embodiment of the computer form of the game is to connect it to a television set or other display device so that the predictions, the scores, the generated events, etc., are displayed as the game progresses.

In other embodiments of the invention, the ramdon events may be generated by mechanical devices such as roulette wheels, throwing of dice, etc. and the game played in the manner described herein.

BRIEF DESCRIPTION OF THE DRAWINGS

For a complete understanding of this invention, reference should be made to the accompanying drawings in which.

DESCRIPTION OF THE PREFERRED EMBODIMENTS

Figure 1:
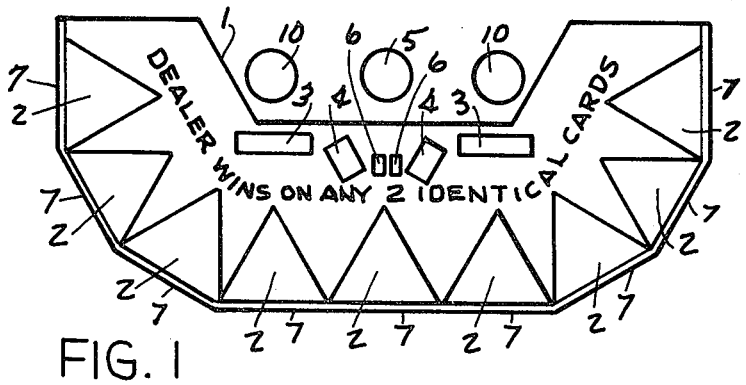
FIG. 1 is a plan view of a preferred embodiment of the game table surface or layout which may be made of any suitable material, such as cloth.

Referring now to FIG. 1, the U-shaped game playing surface 1, mounted on a table or the like, is provided with nine player areas 2, dealer's chip racks 3, two dealing shoes 4 for holding four decks of conventional playing cards each, two dealtcard display areas 6, and player's chip racks 7. The game playing surface is provided with wording stating the basic rule and principle of the game, namely, dealer wins on any two identical cards. The dealer is conveniently positioned at 5 and his assistants at 10.

Figure 2:
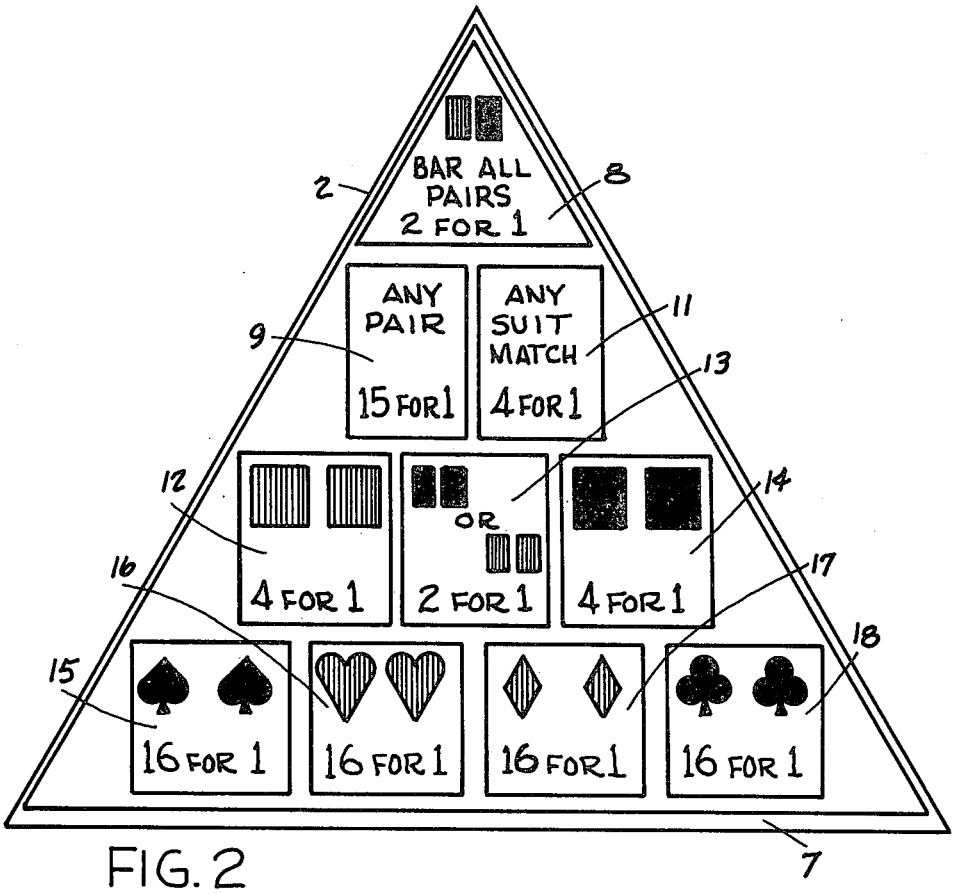
FIG. 2 is an enlarged detail of a player area shown as 2 in FIG. 1.

In FIG. 2 is illustrated a preferred arrangement of a player area, each of which has ten prediction spaces. Prediction space 8 is for chips indicating a prediction that the dealt cards will be one red and one black, but not a pair. The odds are given as two for one. Prediction space 9 is for indicating a prediction that the deal will be a pair, e.g., fours, queens, tens, etc., and the probability is shown as fifteen for one. The prediction space 11 is for a prediction that the dealt cards will be of the same suit, i.e. spades, hearts, diamonds or clubs, and the reward ratio is four for one. Space 12 is for predicting that both cards will be red, with payoff of four for one. Prediction space 13 is for indicating a prediction that the dealt cards will be either both black or both red, the odds, or payoff, being two for one. Space 14 is for predicting that both cards will be black and shows odds of four for one. The four spaces for predicting that the dealt cards will both be spades is 15, or hearts 16, or diamonds 17, or clubs 18 are at the side nearest the player with the payoff for each instance being shown to be sixteen for one. The chip rack 7 is for conveniently holding a player's unplayed or accumulated chips, the number of these indicating the degree of success the player has achieved in making predictions of what successive deals would be.

As mentioned above, the table has nine player areas and can accommodate one to nine players comfortably, however, if players wish to share areas, the game can be played with more than nine players at the table. The players place their chips on one of these areas to indicate the belief that the two cards about to be dealt with produce that particular result. If that event does occur, the player is paid a number of chips according to the odds quoted on that space of the player area. For example, if a player places chips on red-red (space 12) and two red cards are dealt, he receives four chips in exchange for every one chip he has on that space. If that event (two red cards) does not occur the player loses his chips to the dealer. As another example, a player places six chips on spade-spade (space 15). If both cards dealt are not spades, he loses these six chips. If both cards are spades, he receives a total of ninety-six chips.

If at any time two identical cards are dealt, the dealer wins from all players, regardless of the accuracy of their predictions. For example, a player predicts club-club (space 18) and the two cards dealt are both the ace of clubs. This player and all others lose to the dealer.

If a player places chips on the red-black triangle (space 8) he loses if two black cards are dealt, he loses if two red cards are dealt, and he wins if a red card and a black card are dealt and are not a pair. In the case of a red-black prediction, when the dealt cards are a pair (e.g. king of hearts—king of spades) it is a tie and the player neither wins nor loses and the chips on the red-black space 8 must remain there until the next deal which does not produce a pair, at which time the player wins if the cards are red-black and loses if the cards are red-red or black-black, or if the dealt cards are identical.

If a player places chips on space 13, he is predicting that the next two cards dealt with be either both red or both black and either result wins. If the player puts chips on space 11, he is predicting that the two cards will be both spades, or both hearts, or both diamonds, or both clubs. Any other combination will cause him to lose. If he uses space 9, the rank of the two cards must be the same in order for him to win, e.g. two kings, two fours, two tens, etc.

Each player may make predictions in any combination of any one or more of the playing spaces he desires. He will receive payoffs on his winners as indicated on the playing area. When he loses, his chips will be removed from each area of a losing prediction. After this is done, the two cards just dealt are removed from the display boxes 6 to discard areas adjacent the shoes 4, face down, and the dealer calls for new predictions. After the new predictions are placed on the layout, the next two cards are dealt and the game proceeds in this manner until the indicator card is reached. At this time there is a reshuffle of all cards, a cut of both packs of cards, the cards are placed in the shoes and made ready to deal, and the dealer calls for the placement of predictions.

A specific example of a game will now be described. Each of two assistants take up four decks of fifty-two cards each and shuffle them thoroughly. Each assistant then presents his four decks to a player to be cut. They then place the decks into the shoe 4 nearest them, face down. The cards are then ready to deal. The dealer places an indicator card in one of the shoes approximately halfway into the four decks. He then "burns" (removes) eight cards from each shoe face down and places them in the respective discard locations beside the shoes. There are now two hundred cards in each shoe. The dealer then announces "place your predictions please". After waiting for the players to place their chips he announces "no more predictions". The dealer then deals two cards, one from each shoe, face up on the display boxes 6. He then announces the two cards such as "spade-spade", "black-black", "a suit match", etc. If the cards are red-black and are a pair, the dealer announces "we have a pair on red-black, all predictions on red-black must ride until the next round". At the point a decision is reached, the chips on red-black are either won or lost. Winning predictions are paid and chips for losing predictions are removed from the layout. The dealer then removes the two cards from the display boxes and places them face down in the discard piles. He then announces "place your predictions please" and then "no more predictions". He then deals the next two cards, face up, into the display boxes and those predictions are won or lost. The game continues in this manner until the indicator card is reached, at which time the game stops and the shuffle, as previously described, is accomplished. The next round of the game is then begun.

While I have shown and described an embodiment in accordance with my invention, it is to be clearly understood that the same is susceptible of changes and modifications without departing from the scope and spirit of my invention as will be apparent to one of ordinary skill in this art. For example, the game surface can be constructed of smaller size so as to be portable for parlor use or of larger size as a permanent installation to accommodate more players. Also, variations of method of play may be used without departing from the underlying principle of the game. Accordingly, I do not wish to be limited to the details shown and described herein but intend to cover all such changes, modifications and variations as are encompassed by the scope of the appended claims and within the intendment of the present invention.

I claim:

1. A game adapted to be run by an operator and which may involve one or more players, and comprising two separate sets of conventional playing cards, with each playing card having one of thirteen rankings, one of four suits, and one of two colors, and a table having a plurality of defined player areas, with each player area having a plurality of distinct regions, with the regions each including a visual representation of a possible relationship between the rankings, or suits, or colors, or a combination thereof, of a dealt playing card from each set, and with the possible relationship represented at each region being different from that represented at the other regions.

2. The game as defined in claim 1 wherein said table further includes two closely adjacent designated spaces for receiving and displaying dealt cards from the respective sets of cards.

3. The game as defined in claim 1 or 2 further including prediction indication means adapted to be positioned on a selected region by each player.

4. The game as defined in claim 1 or 2 further including visual means associated with each of said regions for displaying the approximate probability that the associated relationship will occur.

* * * * *